US009204766B2

(12) United States Patent
Wang

(10) Patent No.: US 9,204,766 B2
(45) Date of Patent: Dec. 8, 2015

(54) PRESS HEAD ASSEMBLY

(71) Applicant: Ya-Tsan Wang, HsinChu (TW)

(72) Inventor: Ya-Tsan Wang, HsinChu (TW)

( * ) Notice: Subject to any disclaimer, the term of this patent is extended or adjusted under 35 U.S.C. 154(b) by 99 days.

(21) Appl. No.: 14/083,458

(22) Filed: Nov. 19, 2013

(65) Prior Publication Data

US 2015/0136807 A1 May 21, 2015

(51) Int. Cl.

*B05B 11/00* (2006.01)
*A47K 5/14* (2006.01)
*A47K 5/12* (2006.01)

(52) U.S. Cl.

CPC . *A47K 5/14* (2013.01); *B05B 11/00* (2013.01); *B05B 11/3023* (2013.01); *B05B 11/3026* (2013.01); *B05B 11/3087* (2013.01); *A47K 5/1205* (2013.01)

(58) Field of Classification Search

CPC ..... B05B 11/3023; B05B 11/3026; B05B 11/3087
USPC ..... 222/190
See application file for complete search history.

(56) References Cited

U.S. PATENT DOCUMENTS 5,443,569 A * 8/1995 Uehira et al. ..... B05B 7/0031 222/190
6,536,629 B2 * 3/2003 van der Heijden .. B05B 11/0005 222/190
7,735,692 B2 * 6/2010 Nelson ..... B05B 11/3087 222/153.13
8,561,849 B1 * 10/2013 Wang ..... 222/190
2006/0219738 A1 * 10/2006 Ilzuka et al. ..... 222/190
2012/0241477 A1 * 9/2012 Uehira et al. ..... B05B 11/0064 222/190

* cited by examiner

*Primary Examiner* — Daniel R Shearer
(74) *Attorney, Agent, or Firm* — C. G. Mersereau; Nikolai & Mersereau, P.A.

(57) ABSTRACT

A spray head assembly includes a press head, a mount, a netted member, an air valve, a first piston, a rod, a main part, a resilient member, a restriction member, a second piston, a vale, a cylinder and an urging member. The press head is connected with the air valve which is connected to the netted member, the first piston and the second piston on one end of the rod and main part. The rod extends through the main part and is located in the cylinder. The valve is engaged with an opening of the cylinder. The mount and the cylinder are connected to each other. Liquid and air are mixed to generate fine foam which is obtain from the press head.

1 Claim, 5 Drawing Sheets

PRESS HEAD ASSEMBLY

BACKGROUND OF THE INVENTION (1) Fields of the Invention

The present invention relates to a spray head assembly, and more particularly, to a spray head assembly for ejecting foam-type mixture.

(2) Descriptions of Related Art

The conventional detergent, lotion or shampoo products usually includes a bottle with a spray head assembly which sucks the liquid of the detergent and ejects the detergent, lotion or shampoo out from the spray head assembly. However, when the ejected detergent, lotion or shampoo is required to be in foam form, the common way is to eject the liquid detergent, lotion or shampoo and then scrub the detergent, lotion or shampoo to become foam. Nevertheless, the amount of the detergent, lotion or shampoo is difficult to be controlled, when too much of the detergent, lotion or shampoo is used, debris may be left to the plates or skin and that is harmful to the user's health.

The present invention intends to provide a spray head assembly which allow the users to get foam type detergent, lotion or shampoo easily.

SUMMARY OF THE INVENTION

The present invention relates to a spray head assembly and comprises a press head having an outlet. A netted member is located in the press head and has a tube, a first net and a second net. An air valve has an air intake and an air passage defined in the first end thereof, and the second end of the air valve is connected to the netted member and the press head.

A first piston is a ring and connected to the air valve. The first piston has a sealing member and a wall which is movable to seal or open the air intake. A main part is a hollow tube and has an air room and an inclined wall wherein the sealing member contacts the air room and is movable to close or open the air room. The main part has an end resiliently connected to outside of the air valve. A rod extends through the main part and has a tapered head, a body and a tip end, and a neck is formed between the body and the tip end. An outgoing path is defined between the outside of the tapered head and the inside of the inclined wall. A mixing room is defined in the tapered head. A second piston is a ring and connected to the rod and the main part. A cylinder is connected with a mount and has an air chamber and a liquid chamber. A restriction member is located between the air chamber and the liquid chamber. Each of the air chamber and the liquid chamber is an enclosed chamber. The first piston is movable back and forth in the air chamber, and the second piston is movable back and forth in the liquid chamber. A resilient member is mounted to the outside of the main part and contacts the restriction member. A valve is located in an opening of the cylinder.

Preferably, the valve is a bead which moves upward to open the opening, and moves downward to close the opening.

Preferably, the opening of the cylinder is connected with a hose.

Preferably, the liquid chamber has a suction way for receiving the valve.

Preferably, the apertures in the first net are larger than those in the second net.

Preferably, the first net or the second net is made by way of injection molding.

Preferably, the apertures of the first net and/or the second net are polygonal apertures.

Preferably, the mount has threads defined in the inside thereof for being connected with a bottle. An urging member is located in the mount to seal an opening of the bottle.

Preferably, the press head has a first downward position and a second downward position.

Preferably, a first gap is defined between the rod and the main part.

Preferably, a second gap is defined between the rod and the second piston.

Preferably, the tip end of the rod protrudes from the second piston and has a shoulder which is resiliently in contact with the stop of the second piston.

Preferably, an incoming path is defined between the shoulder and the stop.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
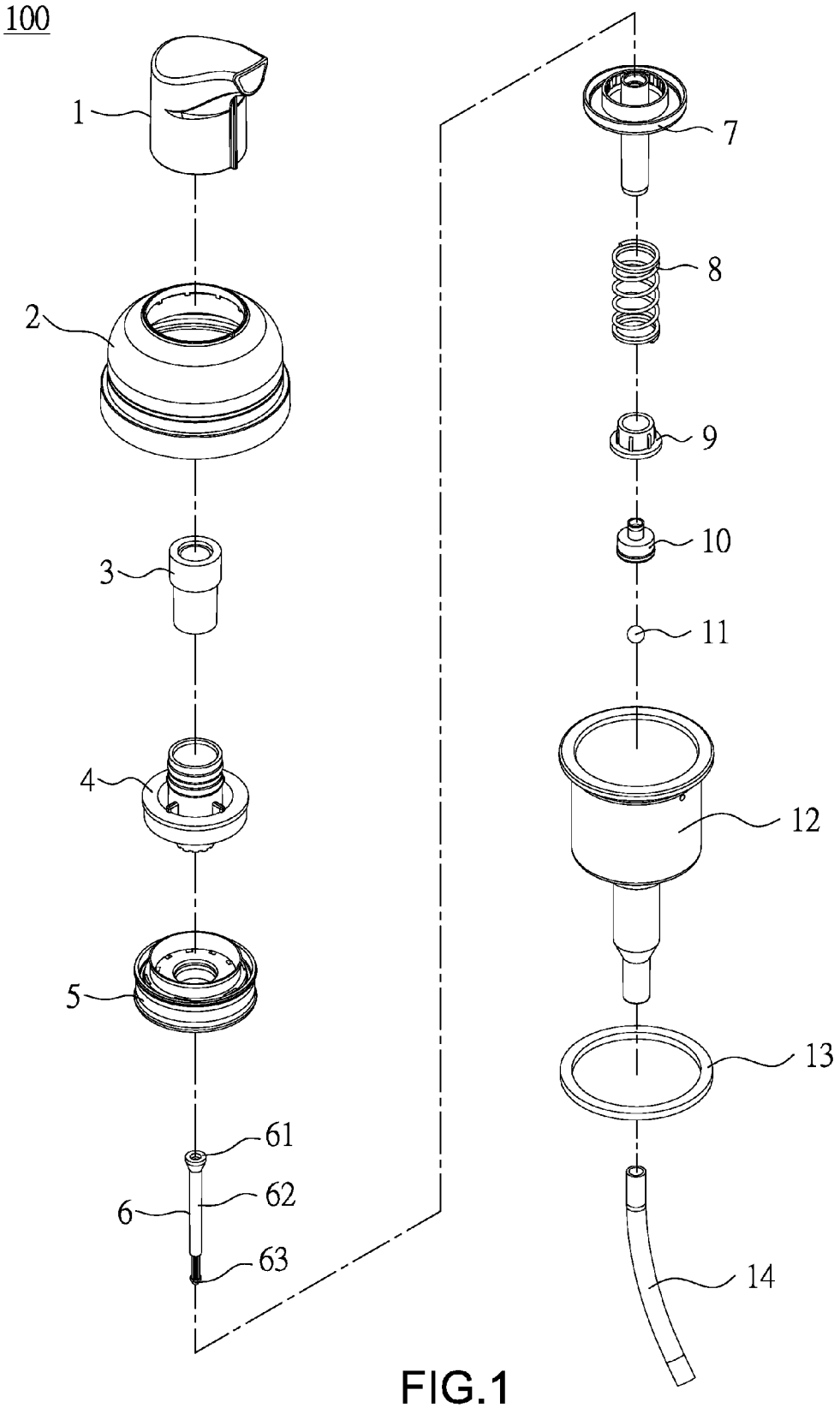
FIG. 1 is an exploded view of the spray head assembly of the present invention.

Referring to FIG. 1, the spray head assembly 100 of the present invention comprises a press head 1, a mount 2, a netted member 3, an air valve 4, a first piston 5, a rod 6, a main part 7, a resilient member 8, a restriction member 9, a second piston 10, a vale 11, a cylinder 12 and an urging member 13.

The press head 1 has an outlet 101 from which the foam material is ejected. The netted member 3 is located in the press head 1 and has a tube 33, a first net 31 and a second net 32. The liquid and air can be fully nixed when passing through the first and second nets 31, 32.

Figure 5:
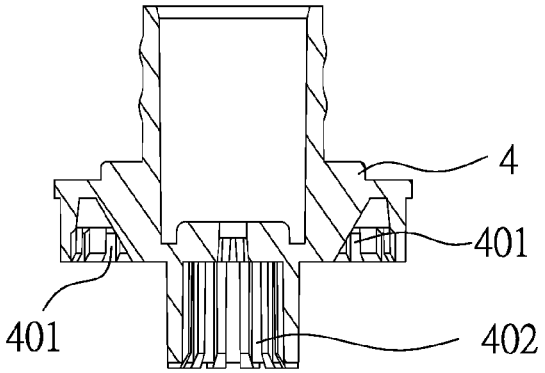
FIG. 5 is a cross sectional view of the air valve of the spray head assembly of the present invention.
Figure 6:
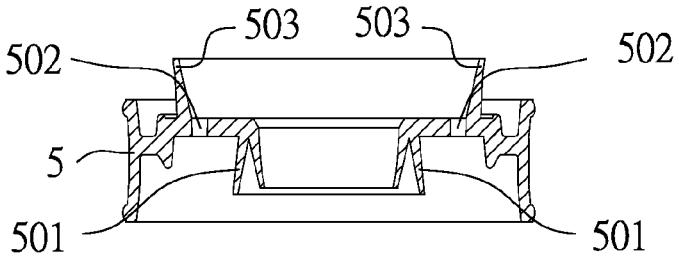
FIG. 6 is a cross sectional view of the first piston of the spray head assembly of the present invention.
Figure 7:
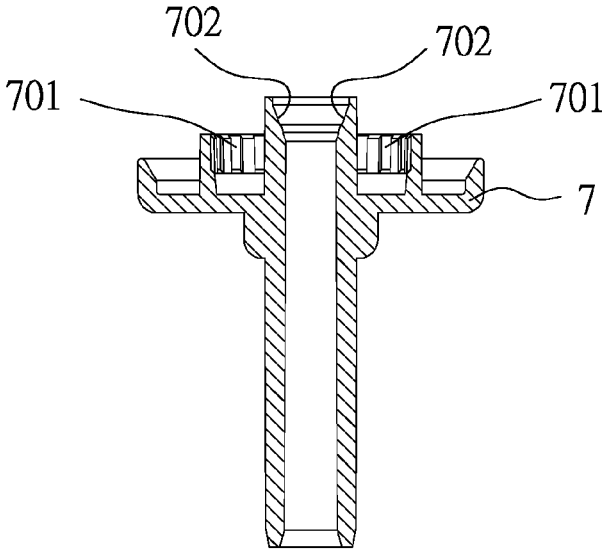
FIG. 7 is a cross sectional view of the main part of the spray head assembly of the present invention.

As shown in FIG. 5, the air valve 4 has an air intake 401 and an air passage 402 defined in the first end thereof, and the second end of the air valve 4 is connected to the netted member 3 and the press head 1. As shown in FIG. 6, the first piston 5 is a ring and connected to the air valve 4. The first piston 5 has a sealing member 501, a hole 502 and a wall 503 which is movable to seal or open the air intake 401. As shown in FIG. 7, the main part 7 is a hollow tube and has an air room 701 and an inclined wall 702. The sealing member 501 contacts the air room 701 and is movable to close or open the air room 701. The main part 7 has an end resiliently connected to outside of the air valve 4.

Figure 2:
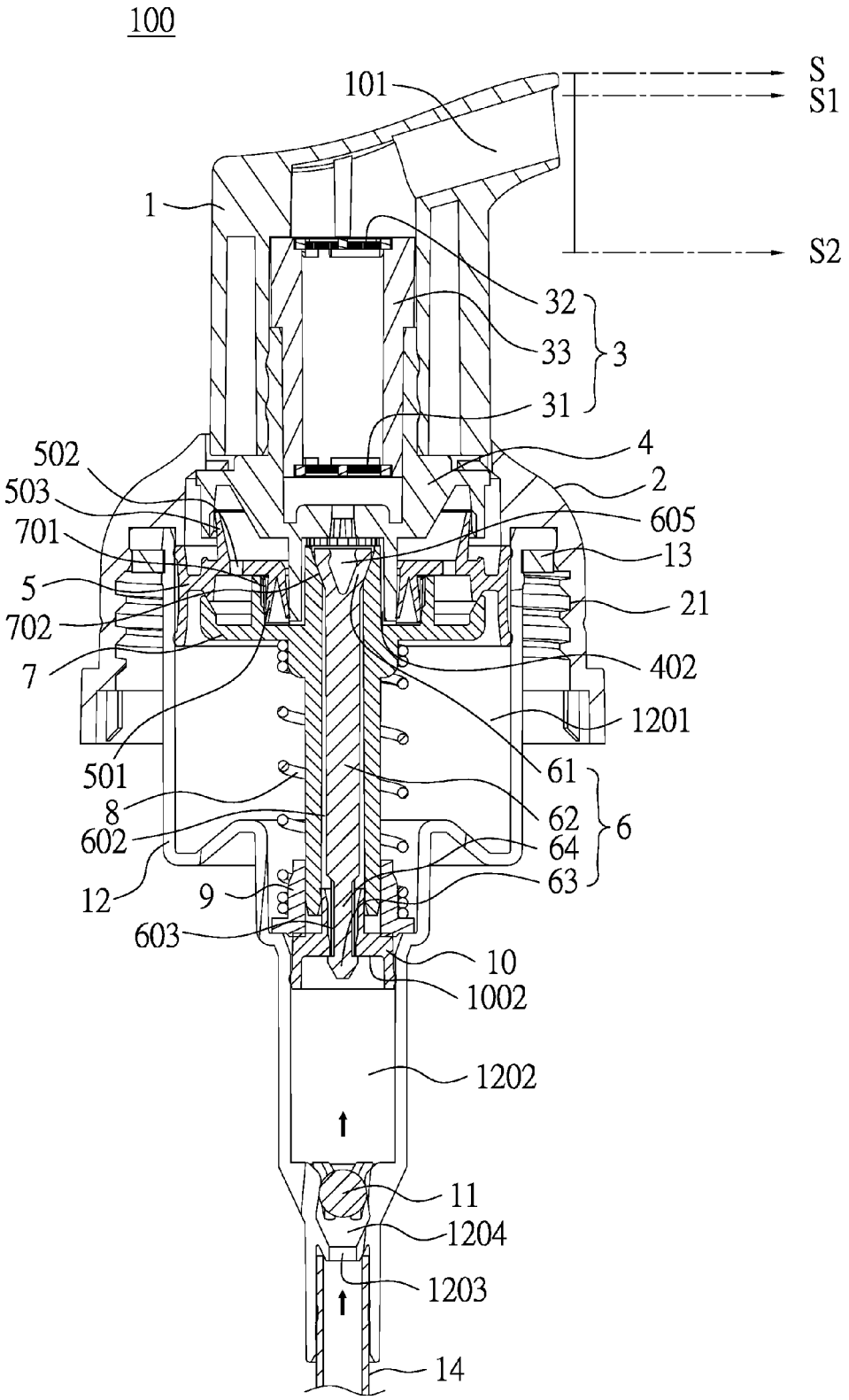
FIG. 2 is a cross sectional view of the spray head assembly of the present invention.

As shown in FIGS. 1 and 2, the rod 6 extends through the main part 7 and has a tapered head 61, a body 62 and a tip end 63. A neck 64 is formed between the body 62 and the tip end 63. The outside of the tapered head 61 contacts the inside of the inclined wall 702 and an outgoing path 601 is defined between the outside of the tapered head 61 and the inside of the inclined wall 702. A mixing room 605 is defined in the tapered head 61.

The second piston 60 is a ring and connected to the rod 6 and the main part 7. The cylinder 12 is connected with the mount 2 and has an air chamber 1201 and a liquid chamber 1202. The restriction member 9 is located between the air chamber 1201 and the liquid chamber 1202. Each of the air chamber 1201 and the liquid chamber 1202 is an enclosed chamber.

The first piston 5 is movable back and forth in the air chamber 1201, and the second piston 10 is movable back and forth in the liquid chamber 1202. In this embodiment, the air chamber 1201 is larger than the liquid chamber 1202. The first piston 5 is larger than the second piston 10. The mount 2 has threads 21 defined in the inside thereof so as to be connected with a bottle. An urging member 13 is located in the mount 2 to seal the opening of the bottle. The resilient member 8 is mounted to the outside of the main part 7 and contacts the restriction member 9. The valve 11 is engaged with the opening 1203 of the cylinder 12.

A first gap 602 is defined between the body 62 of the rod 6 and the main part 7. A second gap 603 is defined between the neck 64 of the rod 6 and the second piston 10. The tip end 63 of the rod 6 protrudes from the second piston 10 and has a shoulder 604 which is resiliently in contact with the stop 1002 of the second piston 10. An incoming path 1001 is defined between the shoulder 604 and the stop 1002. The valve 11 located in the opening 1203 of the cylinder 12. The liquid chamber 1202 has a suction way 1204 for receiving the valve 11.

Figure 3:
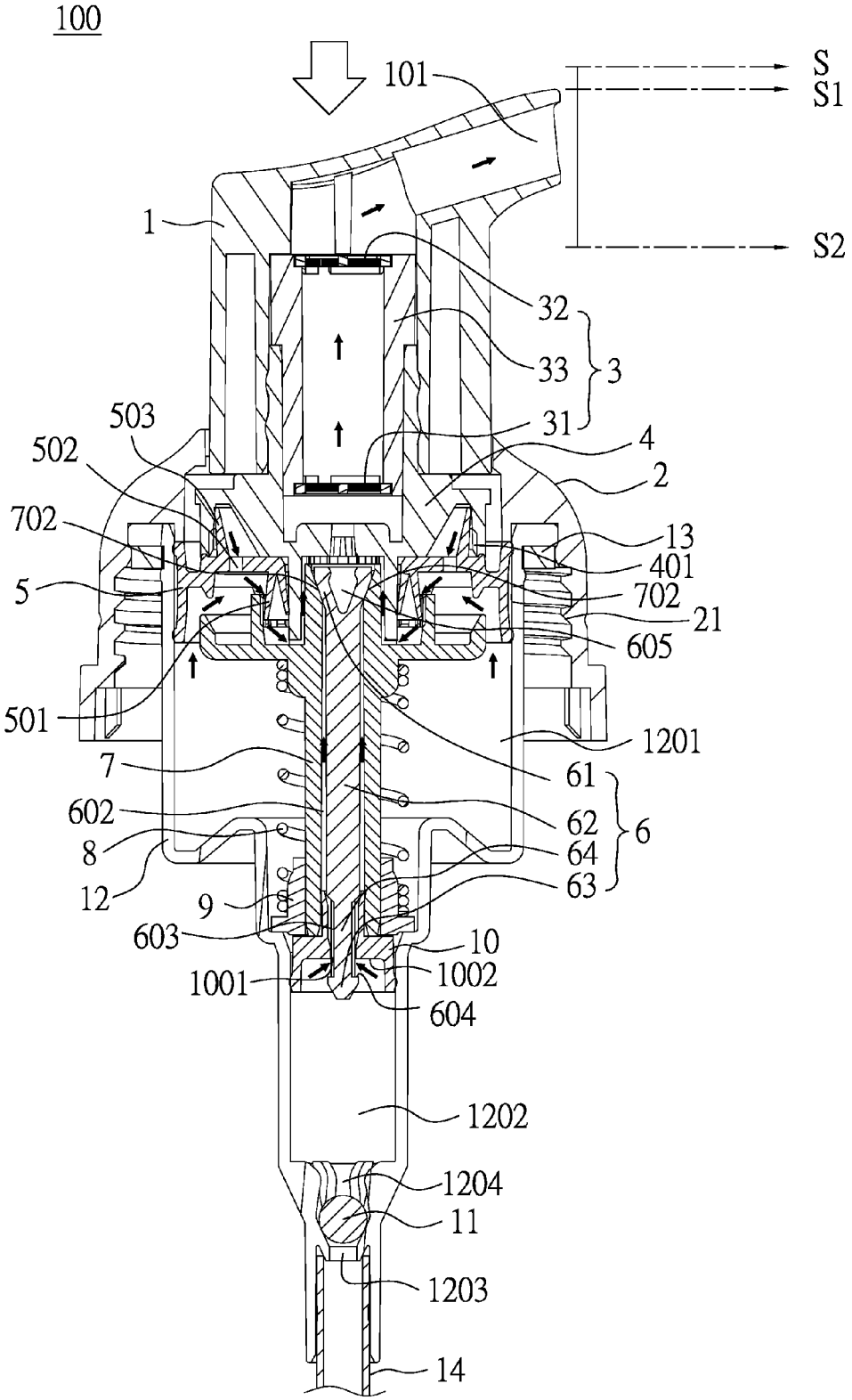
FIGS. 3 and 4 show the status of the spray head assembly of the present invention when the press head is pushed.

As shown in FIG. 3, when pressing the press head 1, the press head 1 is moved to the first downward position S1, the air valve 4, the main part 7 and the rod 6 are co-moved, and the first and second pistons 5, 10 are remained standstill because of friction with the cylinder 12. The shoulder 604 is separated from the stop 1002 of the second piston 10 when the main part 7 moves downward, so that the incoming path 1001 is opened. The rod 6 is moved upward by the pressure from the liquid chamber 1202 of the cylinder 12, so that the tapered head 61 is removed from the inclined wall 702 to open the outgoing path 601. On the other hand, when the air valve 4 is moved to the first downward position S1, the first piston 5 is remained still so that the air intake 401 is gradually closed by the wall 503, and the sealing member 501 gradually opens the air room 701.

Figure 4:
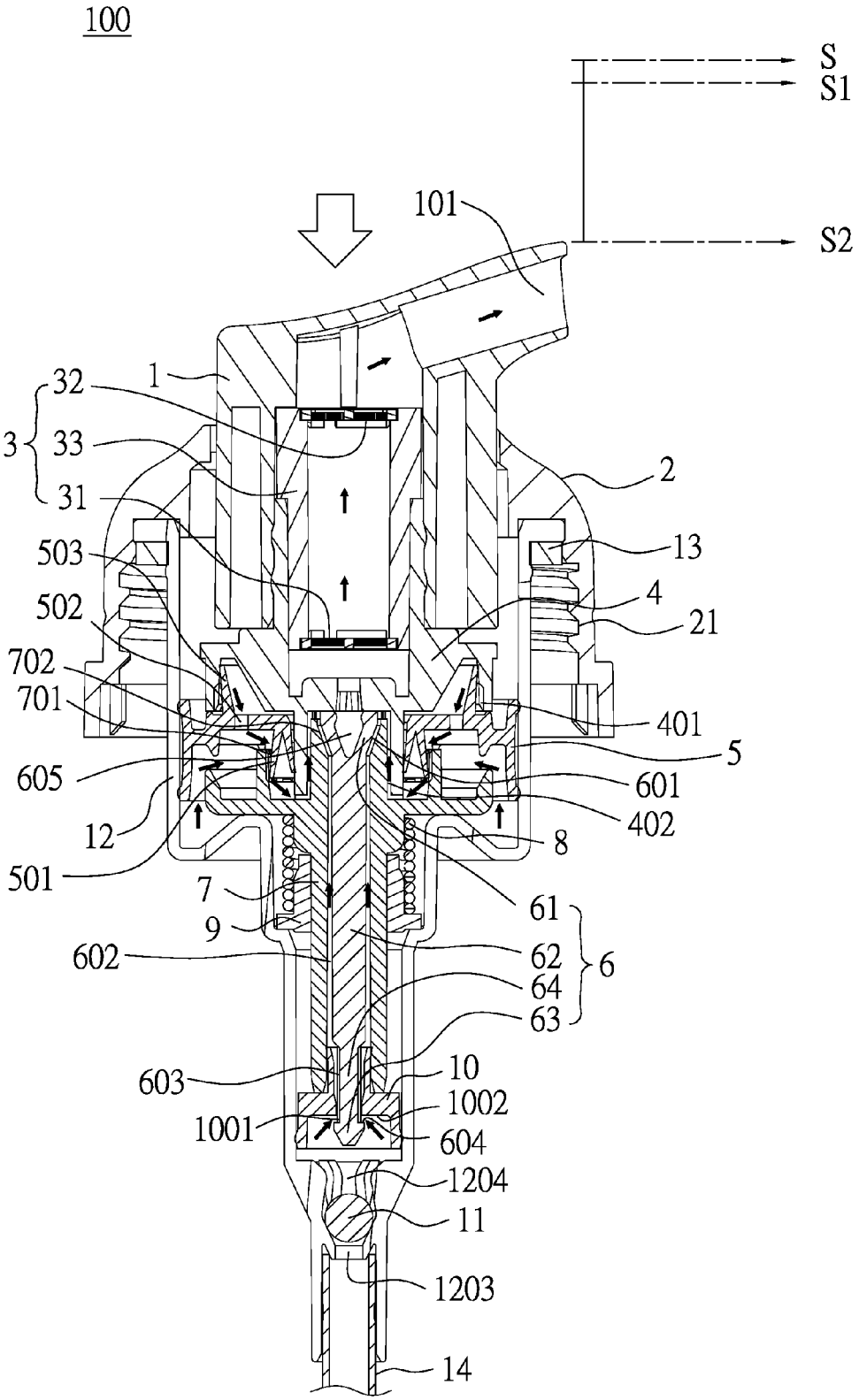

As shown in FIG. 4, when the press head 1 is moved to the second downward position S2, the second piston 10 pushes the liquid in the liquid chamber 1202 so that the liquid passes through the incoming path 1001, the second gap 603, the first gap 602, the outgoing path 601 and enters into the mixing room 605. The air in the air chamber 1201 is pushed by the downward first piston 5 and passes through the air room 701, the air passage 402 and enters into the mixing room 605 to be mixed with the liquid. The mixture passes the first and second nets 31, 32 to form as foam combination which is ejected from the outlet 101 of the press head 1.

When the press head 1 is released, it bounced upward from the second downward position S2 to the first downward position S1. The main part 7, the air valve 4 and the rod 6 are co-moved upward, and the first and second pistons 5, 10 are remained standstill because of friction with the cylinder 12. The rod 6 is moved upward by the main part 7, so that the outgoing path 601 and the incoming path 1001 are gradually closed. The air valve 4 is moved with the main part 7, the first piston 5 is remained still and the air intake 401 is gradually opened. The sealing member 501 gradually closes the air room 701. Along with the upward movement of the main part 7 and the rod 6, when they reach the initial position S, the first and second pistons 5, 10 are moved upward to increase the volume of the air chamber 1201 and the liquid chamber 1202. Outside air is sucked into the air chamber 1201 via the air intake 401 and the hole 502. The liquid in the bottle (not shown) pushes the valve 11 and enters into the liquid chamber 1202 via the opening 1203 so as to be ready for next action.

It is noted that the first net 31 or the second net 32 is made by way of injection molding. Therefore, they are secured by engaging with two ends of the tube 33. In order to get fine foam, the apertures of the first net 31 and/or the second net 32 are polygonal apertures. Alternatively, the apertures in the first net 31 are equal to or larger than those in the second net 32. When the liquid and air pass through the larger apertures of the first net 31 and generate foam which pass through the smaller apertures of the second net 32 to create fine foam.

In this embodiment, the valve 11 is a bead which moves upward to open the opening 1203, and moves downward to close the opening 1203. Furthermore, the opening 1203 of the cylinder 12 is connected with a hose so as to suck the liquid in a bottle (not shown).

Besides, the resilient member 8 is mounted to the outside of the main part 7, and when the incoming path 1001 is opened, the liquid passes through the second gap 603, the first gap 602, the outgoing path 601, and enters into the mixing room 605 to avoid the resilient member 8 from being in contact with the liquid so that the resilient member 8 is protected from being rusted, and the liquid is not contaminated by the resilient member 8.

While we have shown and described the embodiment in accordance with the present invention, it should be clear to those skilled in the art that further embodiments may be made without departing from the scope of the present invention.

What is claimed is:

1. A spray head assembly comprising:

a press head having an outlet, the press head having a first downward position and a second downward position;

a netted member located in the press head and having a tube, a first net and a second net, apertures of the first net and/or the second net being polygonal apertures, the apertures in the first net being larger than those in the second net, the first net or the second net being made by way of injection molding;

an air valve having an air intake and an air passage defined in a first end thereof, a second end of the air valve connected to the netted member and the press head;

a first piston being a ring and connected to the air valve, the first piston having a sealing member, a hole and a wall which is movable to seal or open the air intake;

a main part being a hollow tube and having an air room and an inclined wall, the sealing member contacting the air room and being movable to close or open the air room, the main part having an end resiliently connected to outside of the air valve;

a rod, being a single solid piece without a junction, extending through the main part and having a tapered head, a body and a tip end, a neck formed between the body and the tip end, an outgoing path defined between an outside of the tapered head and an inside of the inclined wall, a mixing room defined in the tapered head, a first gap defined between the rod and the main part;

a second piston being a ring and connected to the rod and the main part, a second gap defined between the rod and the second piston, the tip end of the rod protruding from the second piston and having a shoulder which is resiliently in contact with the stop of the second piston, an incoming path defined between the shoulder and the stop;

a cylinder connected with a mount and having an air chamber and a liquid chamber, a restriction member located between the air chamber and the liquid chamber, each of the air chamber and the liquid chamber being an enclosed chamber, the first piston movable back and forth in the air chamber, the second piston movable back and forth in the liquid chamber, the mount having threads defined in an inside thereof for being connected with a bottle, an urging member located in the mount and adapted to seal an opening of the bottle, wherein the restriction member has a sleeve and a flange extending from an end of the sleeve, and the sleeve is inserted into an end of a resilient member;

the resilient member mounted to an outside of the main part and contacting the restriction member; and a valve being a ball located in a suction way of the liquid chamber of the cylinder, the valve moving upward to open an opening of the cylinder, and moving downward to close the opening of the cylinder, the opening of the cylinder connected with a hose.

* * * * *